US008915006B2

(12) United States Patent
Torre et al.

(10) Patent No.: US 8,915,006 B2
(45) Date of Patent: Dec. 23, 2014

(54) SPORTS RIFLE

(75) Inventors: Victor Tresserras Torre, Barcelona (ES); Julian Arnedo Vera, Barcelona (ES)

(73) Assignee: Gamo Outdoor, S.L., Barcelona (ES)

( * ) Notice: Subject to any disclaimer, the term of this patent is extended or adjusted under 35 U.S.C. 154(b) by 73 days.

(21) Appl. No.: 13/810,719

(22) PCT Filed: Aug. 2, 2010

(86) PCT No.: PCT/ES2010/070537
§ 371 (c)(1),
(2), (4) Date: Mar. 8, 2013

(87) PCT Pub. No.: WO2012/017097
PCT Pub. Date: Feb. 9, 2012

(65) Prior Publication Data
US 2013/0247438 A1 Sep. 26, 2013

(51) Int. Cl.
*F41A 3/66* (2006.01)
*F41B 11/648* (2013.01)

(52) U.S. Cl.
CPC ..... *F41A 3/66* (2013.01); *F41B 11/648* (2013.01)
USPC ..... 42/75.04; 42/75.02

(58) Field of Classification Search
USPC ..... 42/75.02, 75.03, 75.04
See application file for complete search history.

(56) References Cited

U.S. PATENT DOCUMENTS

| | | | | |
|---|---|---|---|---|
| 4,774,929 | A * | 10/1988 | Milliman | 124/76 |
| 5,205,271 | A | 4/1993 | Casas Salva | |
| 5,575,270 | A * | 11/1996 | Casas-Salva | 124/67 |
| 5,655,509 | A | 8/1997 | Salva | |
| 6,539,659 | B2 * | 4/2003 | Casas Salva | 42/75.04 |
| 7,726,060 | B1 * | 6/2010 | Jones | 42/75.02 |
| 8,522,468 | B2 * | 9/2013 | Webber et al. | 42/75.03 |
| 2011/0119982 | A1 * | 5/2011 | Webber et al. | 42/75.03 |

FOREIGN PATENT DOCUMENTS

| | | |
|---|---|---|
| GB | 945362 | 11/1960 |
| GB | 1219302 | 2/1969 |

* cited by examiner

*Primary Examiner* — Jonathan C Weber
(74) *Attorney, Agent, or Firm* — RatnerPrestia

(57) ABSTRACT

A sporting rifle with a firing mechanism, comprising a chamber (3) joined to a fork (4), a barrel (2), a butt (1) and means of fixing the butt (1) to the fork (4), wherein the fork (4) comprises at least one projecting stop (6) secured to the outside of said fork (4) which, when the fork (4) is positioned on the butt (1), said at least one stop (6) is fitted into a corresponding housing (5) located on the butt (1) and said at least one stop (6) is positioned on the fork (4) with the weld (10) located between the stop (6) and the chamber (3).

7 Claims, 2 Drawing Sheets

SPORTS RIFLE

A sporting rifle with a firing mechanism, comprising a chamber joined to a fork, a barrel, a butt and means of fixing the butt to the fork, characterised in that said fork comprises at least one projecting stop secured to the outside of said fork which, when the fork is positioned on the butt, said at least one stop is fitted into a corresponding housing located on the butt and said at least one stop is positioned on the fork with the weld located between the stop and the chamber.

BACKGROUND TO THE INVENTION

Various sporting rifles are known in the state of the art with a fork system incorporated into the chamber that articulates with the butt.

Thus, Utility Model No 9201525, "PIEZA DE CABEZA DEL TUBO DE COMPRESIóN EN CARABINAS DE AIRE COMPRIMIDO", is known from 1992, in the name of NORBERTO ARIZMENDI, S.A., which refers to a compression tube head piece in compressed air rifles, in particular, a head piece of closing front of the compression tube with a peculiar configuration especially fitted for execution moulded in plastic and generally comprising a fixable core inside said tube, which is fitted with the corresponding paraxial pitch compressed air projector and by the front fork prongs that support the barrel articulation shaft, characterised in that it comprises a single-piece moulded plastic body and in that one of said prongs has an anti-rotation groove with a securing nut for the point of a barrel articulation screw-shaft, the tail of which has a plug-in structure on which the following elements in particular are defined: a pair of peripheral annular channels for reception of the corresponding sealing O-rings; a pair of crosswise drilled for two metal retaining pins, their ends housed inside orifices in the compression tube wall; a pair of blind lower oblique housings in symmetrical contraposition in the same transversal section, oblique housings that have reciprocal polygonal section of the periphery of the two metal nuts it can hold inside; a leading stepped front producing a seating projection for the limiting stop in the closed barrel position; a front channel around said air passage for holding an O-ring; and a front blind hole located in said projection for receiving the double-chamfer retainer metal point for barrel closure.

European Patent No 0260204 "GAS-OPERATED AUTOMATIC RIFLE WITH BREAKING BARREL OR NOT", in name of the firm EXBRAYAT & CIE SOCIÉTÉ EN COMMANDITE SIMPLE, of 1987 also belongs to the state of the art, which relates to a gas-operated automatic rifle. According to the invention, the barrel is mounted with a capacity for forward movement in relation to the magazine tube; the front part of the barrel receives, in its lower part, a sleeve forming internally a gas expansion chamber in communication with the barrel; the magazine tube has an extension partially engaging into the sleeve, without closing the orifice for the passage of the gases; a piston slides in the sleeve under the thrust of the gases and acts counter to the barrel recovery spring by a means for the purpose of releasing the barrel and displacing it in relation to the magazine tube; the means is secured to a pair of rods sliding along the magazine tube and the rocker in order to allow the cocking of the striker and the return of the means for lifting cartridges into the barrel tube.

Spanish Patent No ES2194564, "BARREL ARTICULATION DEVICE FOR A COMPRESSED AIR SPORTING RIFLE OR PISTOL WITH BREAKING BARREL" from the same applicant firm, belongs to the state of the art, which refers to a barrel articulation device for a compressed air sporting rifle or pistol with breaking barrel that comprises a barrel box connected to the rear end of the barrel, with articulation and a closing catch with respect to a fork, connected to the front end of a compression chamber. Said box is connected to a lever mechanism that compresses a piston in the compression chamber, with said fork comprising an internal moulded piece that concentrates most complex configurations, that is inserted adjusted and joined to a portion of the mouth of said compression chamber, which is a metal tube that exactly covers said internal fork piece, with the barrel box, also obtained by moulding, with a rear part of the barrel ready for insertion.

BRIEF DISCLOSURE OF THE INVENTION

This invention is an improvement in the sector of sporting rifles fitted with breaking barrels.

The closest document is Spanish Patent ES 2194564. This patent describes a new articulation device for breaking barrels. Although it is not the object of the invention of said patent, it shows a fork that is joined to the chamber. This joint can currently be made by welding.

The inventors have observed that when this type of sporting rifle is fired, the impacts produced in the mentioned chamber are transmitted to the butt by the screws that join the fork to the butt.

Said screws are unable to transmit part of the impact to the butt because the chamber is fixed to the butt by the trigger, and it is the fork that has to absorb the impact, so that the welds that join the fork to the chamber are affected by the forces that are produced against said weld, thus reducing the useful lifetime of the referred welded joints.

Moreover, as a result of the produced forces, the indicated screws become locked, begin to vibrate, which produces looseness and are no longer able to transfer sufficient energy to the butt.

This invention resolves said mechanical stress problem by means of stops located on the outside of the fork so that, when the impact occurs inside the chamber, the excess forces are mainly transferred directly to the butt by the stops. This is achieved because the fork stops are positioned inside housing on the same butt so that, by being in contact, the energy is dissipated by the butt.

Moreover, the forces on the previously mentioned welded joint between the fork and chamber are also reduced. The stops are located after the weld in relation to the user's firing position so that said weld receives less traction force during firing.

This occurs because the energy produced by firing is dissipated by the stops and the welded joint only has to withstand the piston spring recoil. Thus, the useful lifetime of the mentioned welded joint is increased.

It must be added to the above that the stops are very close to the screws joining the butt to the fork so that a mechanically very strong locking point is produced when the rifle is fired.

This is the result of, on the one hand, the fork being better secured to the butt by the stops and the housings of the actual butt and, on the other, the increase of securing points between the butt and fork distributing the forces produced inside the chamber.

Moreover, because of the previously indicated locking point, the firing mechanism can be floating, in other words, does not fix the butt to the cover, so that these firing mechanisms are simplified and their useful lifetime is increased.

Lastly, the chamber and barrel positioning is improved with respect to the butt because the chamber, and hence the fork, are better secured between them.

One object of this invention is a sporting rifle comprising a chamber joined to a fork, a barrel, a butt and means of fixing the butt to the fork characterised in that said fork comprises at least one projecting stop secured to the outside of said fork which, when the fork is positioned on the butt, said at least one stop is fitted into a corresponding housing located on the butt and said at least one stop is positioned on the fork with the weld located between the stop and the chamber.

BRIEF DESCRIPTION OF THE DRAWINGS

In order to facilitate the description, this report is accompanied by two pages of drawings that represent a practical embodiment, which is provided as a non-limiting example of the scope of this invention.

SPECIFIC EMBODIMENT OF THIS INVENTION

Figure 1:
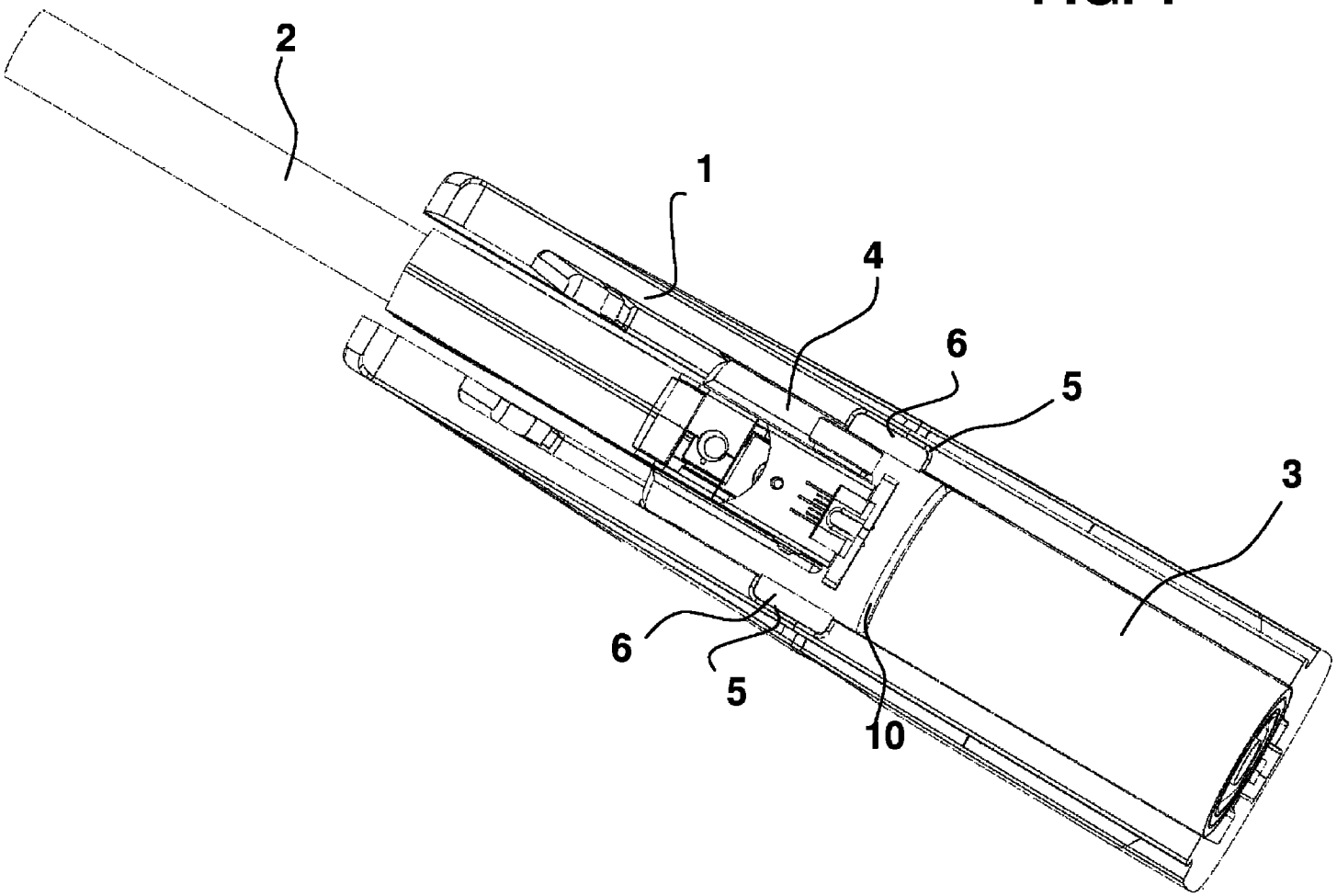
FIG. 1 is a partial elevation view of the barrel articulation area barrel, which is the object of this invention.

Thus, FIG. 1 illustrates a butt 1 with a housing 5, barrel 2, chamber 3 and fork 4, with its welded joint 10 and its stops 6.

Figure 2:
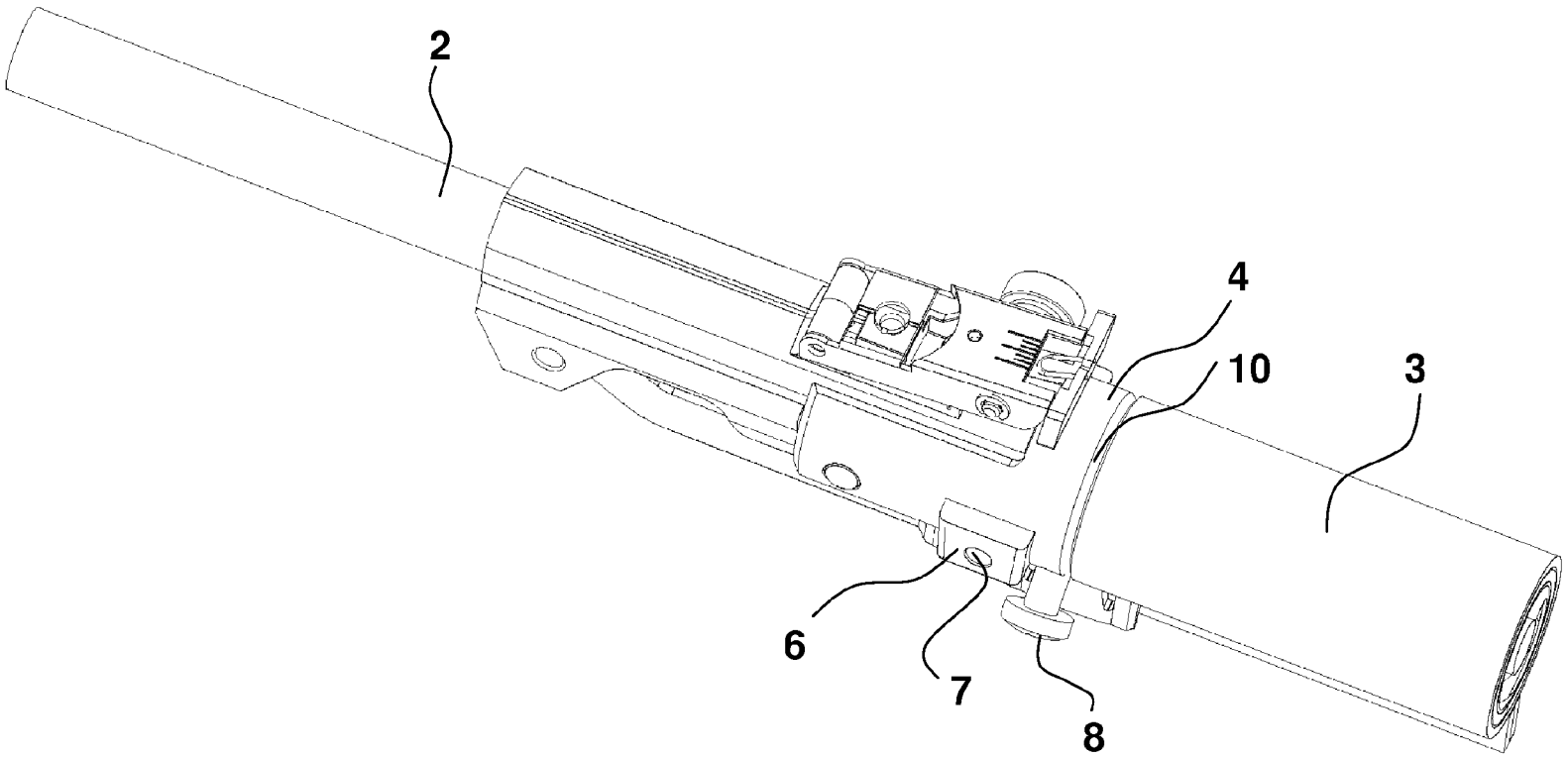
FIG. 2 is a rear lateral perspective view of the mentioned FIG. 1, without the butt.

Lastly, FIG. 2 shows the barrel 2, chamber 3, fork 4, stops 6, securing means 8 and a pin 7.

Thus, in a specific embodiment, there is chamber 3 with fork 4 joined to said chamber 3 by welded joint 10, and breakable barrel 2, in the butt 1 (FIG. 1).

Said fork 4 has stops 6 that fit into housing 5, located on butt 1, so that when the corresponding screws 8 (FIG. 2) are fitted from butt 1 to fork 4, together with the referred stops 6, fork 4 is fitted immobile into the butt 1.

Stops 6 are located after welded joint 10, in relation to the user's firing position.

It must be added to the above that the stops 6 are very close to the screws 8 joining the butt 1 to the fork 4 so that a mechanically very strong locking point is produced as previously stated.

When the firing mechanism (not illustrated) is operated, a series of forces are generated inside the chamber 3 that culminate in the exit of the corresponding pellet from the barrel 2.

There are also mechanical stresses that are dissipated via butt 1. This is partly achieved by the screws 8, but mainly by stops 6, of which are two in this embodiment, but can be just one, fixed to fork 4, joined together by pin 7, which collects the forces from inside the fork 4 after firing in order to dissipate them in the butt 1.

In this way, with stops 6 fitted inside housings 5 of the butt 1, said forces are transferred from the fork 4 to butt 1, thus reducing the forces on the welded joint between chamber 3 and fork 4.

Moreover, with this arrangement, weld 10 receives less traction force during firing. This occurs because the energy produced by firing is dissipated by the stops 6 and the welded joint 10 only has to withstand the piston spring recoil Pin or shaft 7 also has to act as a stop when the barrel 2 is locked.

Depending on the forces produced, in other words, depending on the speed at which the pellet exits, the stops 6 can be configured in the form of longitudinal flat bars, of variable length and forms, depending on the degree of dissipation they have to carry out.

Similarly, said stops 6, depending of the forces and dissipation to carry out, can be manufactured in various materials, such as completely rigid (for example, aluminium, iron or zinc alloys), in an elastic material, such as thermoplastic elastomers and nitrile rubber etc, or in a combination of rigid and elastic materials, for example, zinc with nitrile rubber.

With this special configuration, the firing mechanism (not illustrated), which generally has to withstand part of the recoil forces generated during firing, since most of the forces are dissipated by the stops 6 and screws 8, it can be configured in the sporting rifle in a floating fashion, in other words, said firing mechanism does not join the butt 1 to the chamber 3, so that it only receives residual forces and thus, the useful lifetime of a costly mechanism is increased.

This invention patent describes a new sporting rifle. The examples mentioned here do not limit this invention and thus, can have various applications and/or adaptations, all of which are within the scope of the following claims.

The invention claimed is:

1. A sporting rifle comprising, a chamber (3) joined to a fork (4) by a weld (10), a barrel (2), a butt (1), and means of fixing the butt (1) to the fork (4), wherein said fork (4) comprises at least two projecting stops (6) secured to the outside of said fork (4) which, when the fork (4) is positioned on the butt (1), said at least one stop (6) is fitted into a corresponding housing (5) located on the butt (1) and said at least one stop (6) is positioned on the fork (4) with the weld (10) located between the stop (6) and the chamber (3).

2. A sporting rifle in accordance with claim 1, wherein the at least two stops (6) are joined by a pin (7), with said pin (7) passing through the fork (4) from one side to the other.

3. A sporting rifle in accordance with claim 2, wherein said pin (7) is located under the barrel (2).

4. A sporting rifle in accordance with claim 1, 2 or 3, wherein the referred stops (6) adopt the configuration of flat longitudinal bars.

5. A sporting rifle in accordance with claim 2, wherein the referred stops (6) are manufactured from a rigid material.

6. A sporting rifle in accordance with claim 2, wherein the referred stops (6) are manufactured from an elastic material.

7. A sporting rifle in accordance with claim 2, wherein the referred stops (6) are manufactured from a combination of rigid and elastic materials.

* * * * *